US006735783B2

(12) United States Patent
Phillips

(10) Patent No.: US 6,735,783 B2
(45) Date of Patent: May 18, 2004

(54) HEAD COVERING WITH POUCH

(76) Inventor: Theresa Phillips, 256 Fox Bend Cir., Bolingbrook, IL (US) 60440

( * ) Notice: Subject to any disclaimer, the term of this patent is extended or adjusted under 35 U.S.C. 154(b) by 0 days.

(21) Appl. No.: 10/159,409

(22) Filed: May 31, 2002

(65) Prior Publication Data

US 2003/0221243 A1 Dec. 4, 2003

(51) Int. Cl.[7] ..... A42B 1/04
(52) U.S. Cl. ..... 2/202; 2/204
(58) Field of Search ..... 2/171, 174, 207, 2/202, 204; 132/147, 212

(56) References Cited

U.S. PATENT DOCUMENTS

D135,323 S * 3/1943 Liberatore ..... D2/883
2,665,427 A * 1/1954 Street et al. ..... 2/195.7
2,730,722 A * 1/1956 Colangelo ..... 2/202
2,817,090 A * 12/1957 Toellner ..... 2/195.7
4,462,117 A * 7/1984 Brunelle ..... 2/202
5,161,260 A * 11/1992 Reynolds ..... 2/207
5,490,528 A * 2/1996 Day ..... 132/200
5,566,689 A * 10/1996 Yeater ..... 132/212
6,189,152 B1 * 2/2001 Lofton ..... 2/171

* cited by examiner

*Primary Examiner*—John J. Calvert
*Assistant Examiner*—Katherine Moran

(57) ABSTRACT

A head covering for covering the hair, particularly long or braided hair is provided. The head covering comprises a cap portion for covering the head, a pouch portion for encasing the hair and means to secure the head covering to the head. The head covering may be made of any suitable fabric material and may contain elastic to provide a snug fit.

11 Claims, 4 Drawing Sheets

Fig. 3
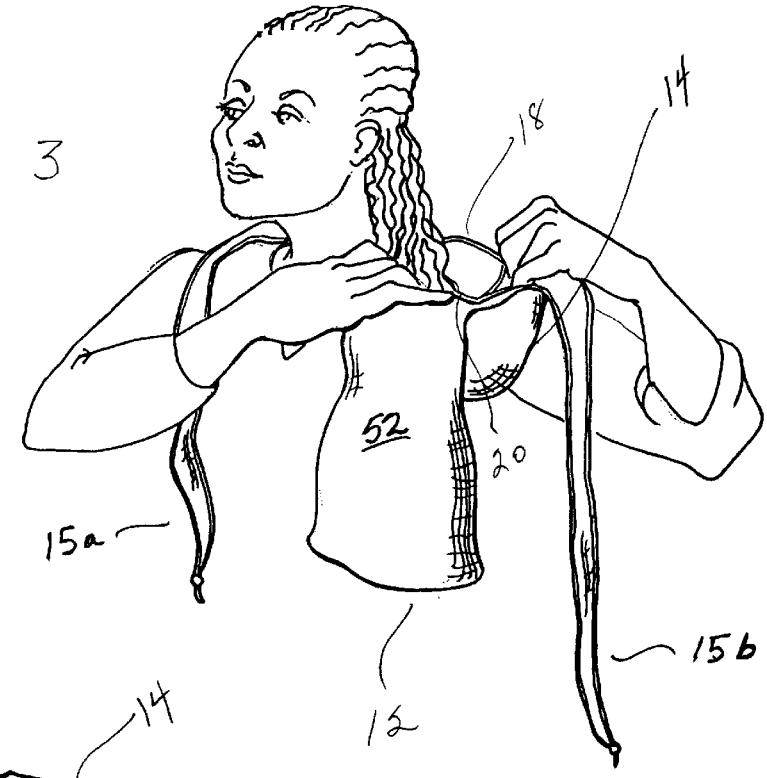
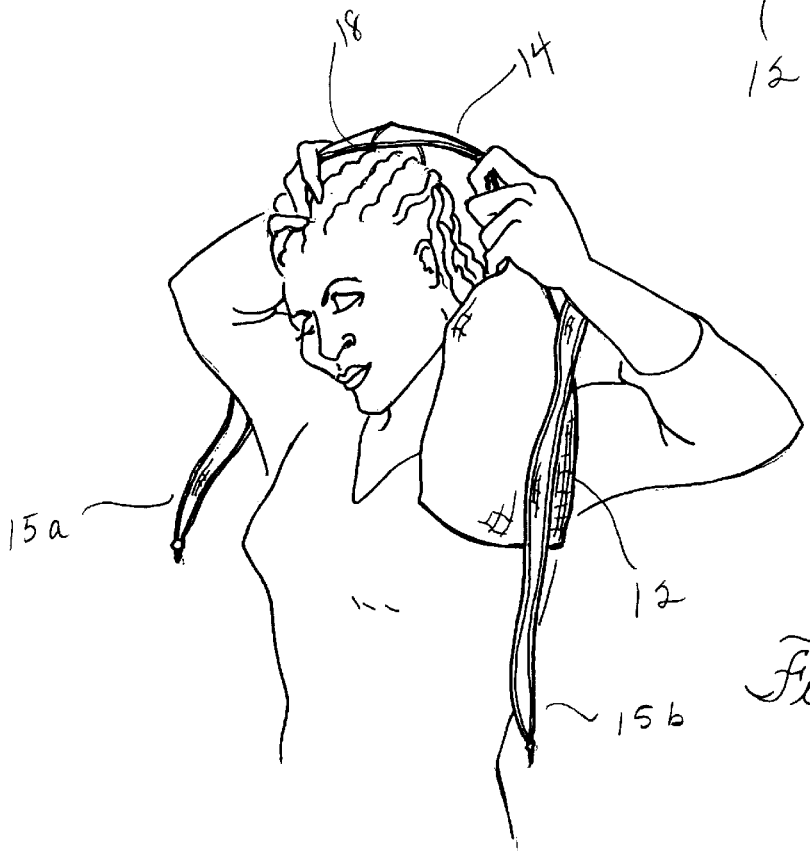
Fig. 4

60
26
28
55
55
42
42
40
38
32
44
30
44
34
36

HEAD COVERING WITH POUCH

FIELD OF THE INVENTION

The present invention relates generally to head coverings and more specifically to a head scarf specially designed to cover and contain long or braided hair.

BACKGROUND OF THE INVENTION

Braided hairstyles have been popular for quite some time. Often, synthetic hair is blended into the braided hair to extend braid length and provide greater versatility in styling. Synthetic hair used for such braided hairstyles may be made from vinyl chloride, nylon or polyester fibers, or other materials. While synthetic hair can be used to produce inexpensive hair extensions for braided hair styles, the texture of synthetic hair made for braiding is generally less soft and pliable than human hair. As described in U.S. Pat. No. 5,677,059, synthetic hair fibers used for making braids may have a modified density and/or cross-section in order to provide the necessary performance characteristics needed to create braided hairstyles. However, synthetic hair fibers of modified density or cross-sections, while highly functional, can feel uncomfortable against the skin, especially while sleeping. It would therefore be desirable to provide a head covering tailored to contain braided hairstyles, particularly during sleep, to avoid skin irritation and discomfort caused by synthetic hair.

There are many head coverings and scarves available on the market today. Slumber caps, traditionally used to prevent heat loss or protect the hair, come in a variety of styles, such as a "bonnet" style, a skull cap style, or a "scrooge" style cap. These types of caps, while useful in covering hair on the crown of the head, do not effectively cover hair extending beyond the nape of the neck without folding the hair toward the crown. Head scarves, bandannas or kerchiefs worn as head coverings are often tied at the nape of the neck or front of the head. Because these scarves typically do not extend beyond the nape of the neck, they are also ineffective for covering longer hair. Other scarves know as "do-rags" are made to cover the crown of the head and contain a long, skirt portion which extends from the back portion of the scarf near the nape of the neck. While such scarves may provide some coverage over the top of longer hairstyles, they do not fully cover the hair and keep the hair from contacting the skin during sleep.

It is therefore desirable to provide a head covering, particularly for use while sleeping, which will fully enclose long or braided hairstyles to protect the skin from irritation.

SUMMARY OF THE INVENTION

The invention provides a specially designed head covering comprising a pouch portion for encasing the hair. The head covering is generally suited for covering long hair styles, and is particularly suited for covering braided hairstyles, especially those utilizing synthetic hair, as it is desirable to keep the synthetic hair out of contact with the skin, especially during sleep.

The head covering comprises a cap portion for covering the head integrally connected to a pouch portion for encasing the hair, with means to secure the head covering in place. The cap portion may be variously sized to fit the wearer. Similarly, the pouch portion of the head covering may be so dimensioned to accommodate hair of various lengths. In a preferred embodiment, the pouch portion is shown in a generally rectangular shape, however, the pouch may be designed in any shape to best accommodate the needs of the user. The pouch is designed to hang loosely beneath the cap to provide excellent comfort and flexibility to the wearer.

The head covering may be made from any suitable natural or synthetic fabric material such as cotton, satin, silk, nylon, polyester, rayon, or blends of these or other materials. In a preferred embodiment, the head covering contains elastic material around the hairline and the nape of the neck to help keep the head covering securely in place.

The means for securing the head covering in place may encompass any means known in the art of securing fabric, including buttons, snaps, zippers, drawstrings and hook and loop fasteners (commonly known by the Velcro® brand). In a preferred embodiment, the means for securing the head covering in place comprises tie members made from fabric extending from the sides of the cap portion, which tie at the back of the head to secure the head covering in place. Other means for securing the head covering may comprise, for example, flaps of fabric extending from the sides of the cap portion with the ends of the flaps containing hook and loop fasteners which hold the flaps in place at the back of the head. Other securing means may include a band of material which fits over the top of the head covering to hold it in place. Such a band of material may have integrated elastic to secure it in place, or the band may utilize a hook and loop fastener, button or other means to secure the head covering in place.

BRIEF DESCRIPTION OF THE DRAWINGS

FIGS. 3–6 illustrate how a user would place the head covering on the head;

FIG. 3 depicts a wearer placing her hair inside the pouch portion of the head covering;

FIG. 4 depicts a wearer placing the cap portion on her head;

FIG. 5 depicts a wearer tying the tie members at the nape of the neck;

FIG. 6 depicts a wearer with the head covering secured in place; and

DETAILED DESCRIPTION OF THE INVENTION

The head covering of the present invention is specially designed to fully encase the hair for the comfort of the user. While the head covering of the present invention may be used for covering hair of any length or style, the head covering is particularly useful for covering braided hairstyles utilizing synthetic hair, especially during sleep, when the synthetic hair may cause discomfort when in contact with the skin.

The head covering of the present invention comprises a cap portion for covering the head and an integrally connected "pouch" portion hanging loosely beneath the cap portion to encase the hair. The pouch portion of the head covering is designed to keep the hair away from the skin, and thus is particularly well suited for use with long hair or hairstyles utilizing synthetic hair.

The head covering is secured to the head by suitable means known in the art for securing fabric; such means include, by way of non-limiting example, buttons, snaps, zippers, drawstrings, and hook and loop fasteners (commonly known by the Velcro® brand). In a preferred embodiment, the means for securing the head covering in place comprises tie members, made from thin extensions of fabric integrally connected to and extending from the cap portion of the head covering. The tie members are tied at the nape of the neck to secure the head covering in place. Alternatively, the means for securing the head covering in place may comprise portions or "flaps" of fabric extending from the cap portion of the head covering, where the ends of the flaps contain hook and loop or other fasteners which secure the flaps at the back of the head. Other means for securing the head covering in place may include separate components, such as a band of material secured by hook and loop fasteners or other means known in the art of securing fabric.

The head covering can be made of any suitable fabric or material such as cotton, satin, silk, nylon, polyester, rayon, or blends of these or other materials. In a preferred embodiment, the head covering contains elastic material around the hairline and the nape of the neck to better secure the head covering in place.

Figure 7:
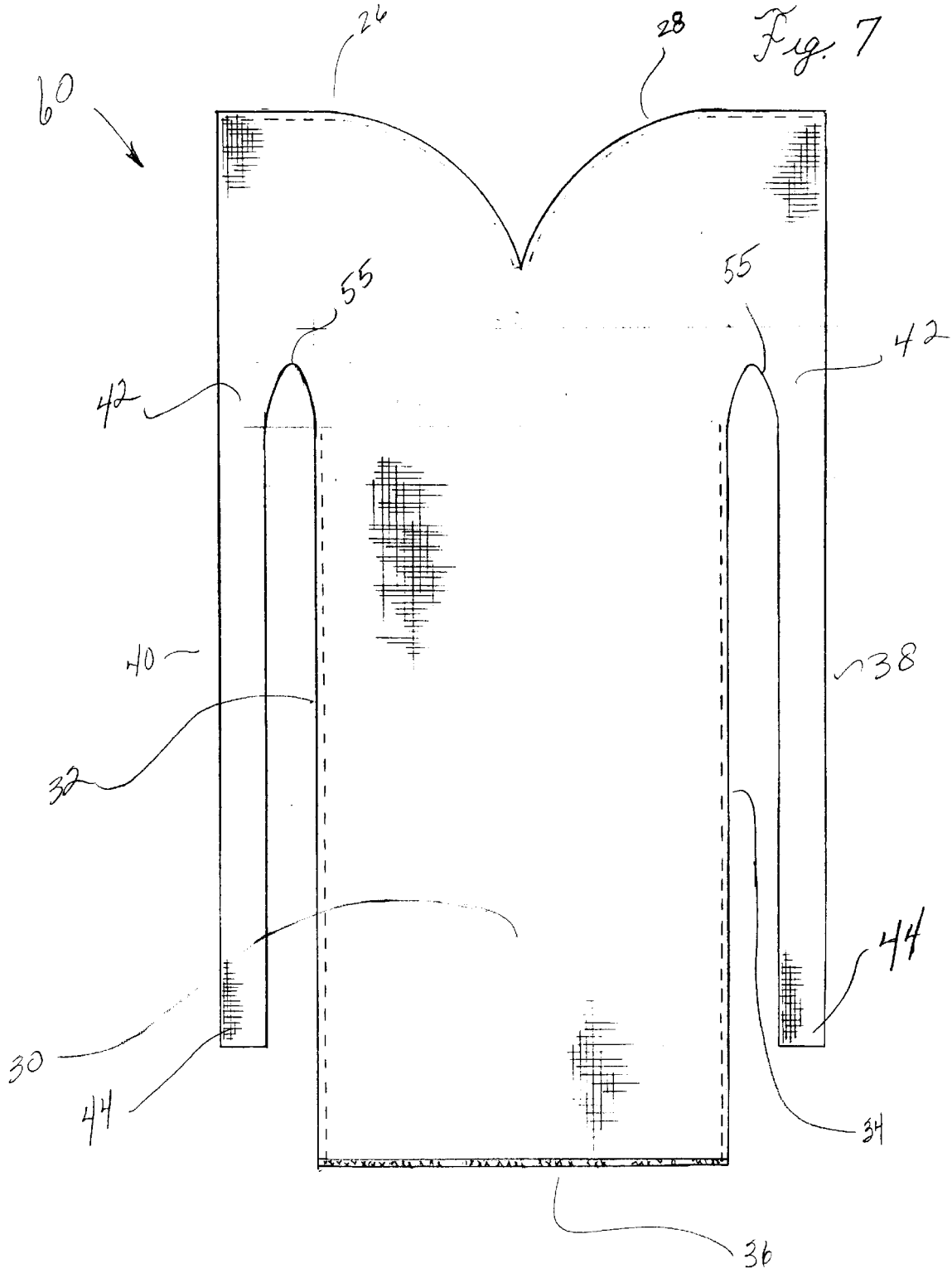
FIG. 7 depicts a blank of the head covering.

In a preferred embodiment, the covering is made from a single piece of material 60. As can be seen in FIG. 7, a blank of the head covering 60 is sewn along edges 26 and 28 to form a seam at the top of the cap portion. The pouch portion is made by folding the rectangular segment of material 30 horizontally at the center and securing the edges 32 and 34 to form the pouch portion. Once formed, the pouch portion has a front wall 52 and back wall 50 joined at the bottom by a fold and at the sides by sewn or secured edges. In a preferred embodiment, the front wall 52 and back wall 50 are seamless and the general shape of the pouch is rectangular. When laid flat, the width of the pouch is slightly broader at the bottom and gradually tapers upward toward the receiving edge of the pouch portion 20 which is somewhat narrower in width due to the elastic encased within the receiving edge of the pouch portion 20.

In a preferred embodiment, the means for securing the head covering in place comprises tie members 38 and 40 formed from strips of material on the sides of the head covering blank 60. The tie members 38 and 40 are integrally connected to and extend downward from the bottom front of the cap portion. The strips of material forming the tie members 38 and 40 separated from the pouch portion 30 by cut outs 55. The top portions 42 of the tie members each have an inner edge formed from curved portions of the cut outs 55 to provide increased width and increased strength. The bottom portions 44 of the tie members comprise linear vertical strips of material.

While the head covering may be produced by a single piece of material, as described herein, the head covering may alternatively be made utilizing multiple segments of material which are sewn or secured together to form the head covering as described.

The head covering may be so dimensioned to fit a variety of users. In a preferred embodiment, the head covering is made from the blank shown in FIG. 7 wherein the rectangular bottom portion defined by edges 32, 36 and 34 has an area of approximately 23"×12". The tie members are approximately 28" in length from the top portion 42 to the bottom portion 44. After being sewn, the cap portion is approximately 9" at its widest point (see FIG. 2, measuring from front edge 18 to back end of cap portion 14). After being sewn, the pouch portion is approximately 11½" long, 12" wide and 10" deep.

Figure 2:
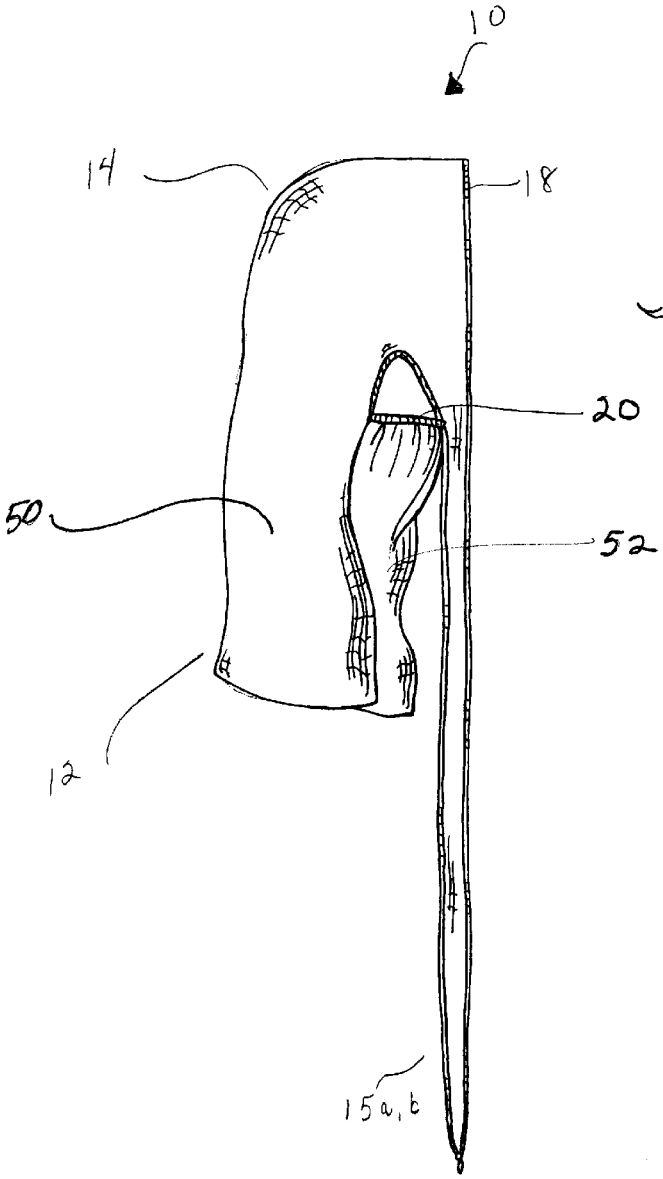
FIG. 2 is a side view of the head covering depicted in FIG. 1.
Figure 1:
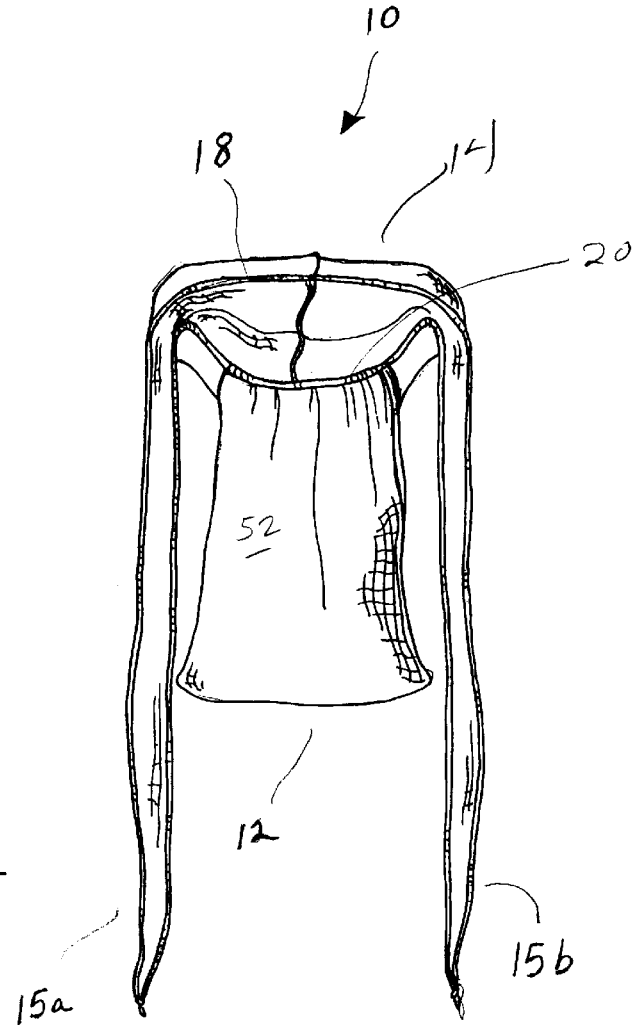
FIG. 1 is a front prospective view of the head covering made in accordance with the present invention.

Turning now FIGS. 1 and 2, the head covering 10 comprises a cap portion 14 for covering the head of the user, a pouch portion 12 for encasing the hair behind the user's head, and two tie members 15*a* and 15*b*, for tying the head covering securely to the head. Means are also provided to secure the mouth of the pouch portion to the hair received therein. In a preferred embodiment of the invention, the front edge of the cap portion 18 and the receiving edge 20 of the pouch portion each have a band of elastic or similar material to more firmly secure the head covering to the head and around the hair at the nape of the neck. In other embodiments, the pouch may be secured by one or more ties, snaps, buttons, straps, hook and loop fasteners, tape, or other fastening arrangements.

Figure 5:
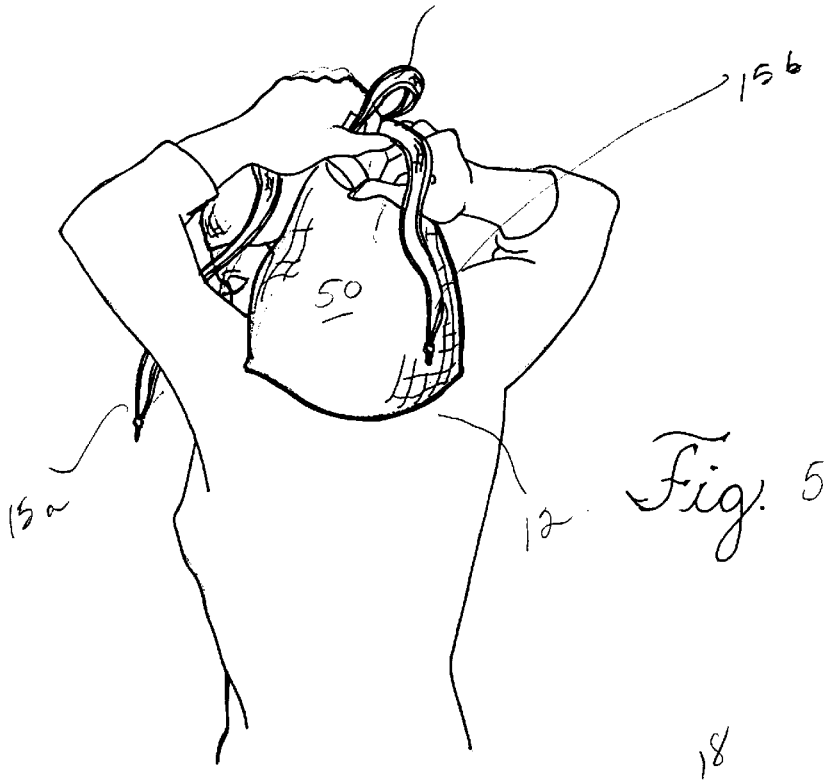
Figure 6:
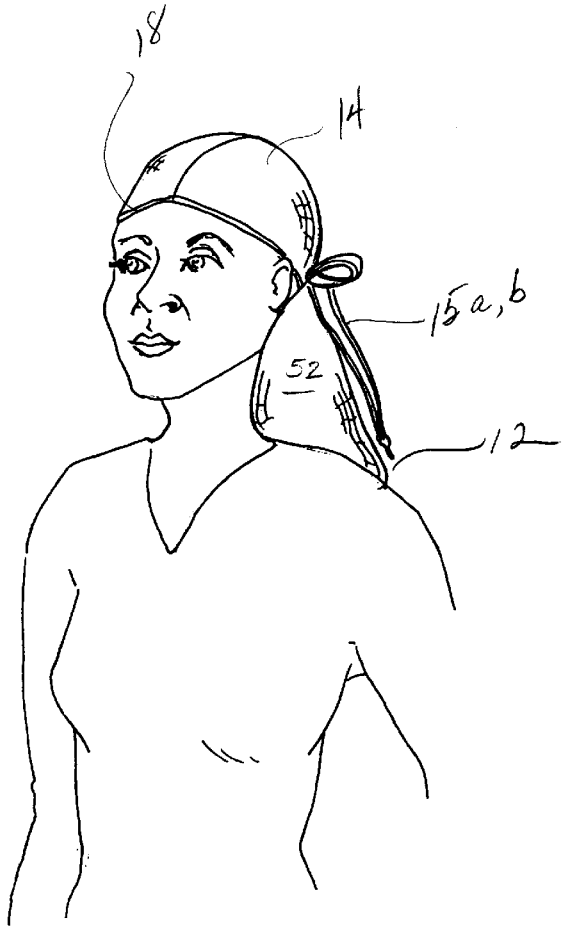

In placing the covering on the head, as illustrated in FIGS. 3–6, a user opens the head covering by holding the front edge of the cap portion 18 and the receiving edge of the pouch portion 20, and places the hair into the pouch portion 12, as depicted in FIG. 3. Once the hair is placed in the pouch portion 12 of the head covering, the user places the cap member 14 over the top of the head as depicted in FIG. 4. To secure the head covering in place, the user then ties the tie members 15*a* and 15*b* at the nape of the neck as depicted in FIG. 5. The ties are preferably positioned over and behind the pouch portion, but might alternatively be tied in front of the pouch portion. As can be seen in the illustration of FIG. 6, once the head covering is in place, the hair is fully encased within the pouch portion 12, with front wall of the pouch portion 52 lying against the back of the user's neck and upper torso.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient, and although specific terms have been employed, they are intended in a generic and descriptive sense only and not for the purposes of limitation, the scope of the invention being delineated by the following claims.

What is claimed is:

1. A head covering comprising:

a cap portion generally contoured to the top of a head of a wearer, said cap portion comprising a front end and a back end;

a pouch portion permitting hair of the wearer to be enclosed by the pouch portion, the pouch portion extending from a point above a nape of a neck of a wearer to a point below the nape of the neck and down at least a portion of a back side of a torso of the wearer, the pouch portion including:

a back wall extending below the nape of the neck, and a front wall extending below the nape of the neck and resting against the neck and back side of the torso of the wearer, wherein the front wall and back wall each have a first edge, a second edge, and a bottom edge such that the edges are respectively secured, wherein the back wall is integral with the back end of the cap portion wherein said pouch portion hangs loosely beneath said cap portion; and tie members connected to the front end of the cap portion.

2. The head covering of claim 1 wherein the cap portion further comprises a front edge, wherein said front edge includes means for securing the head covering to the head.

3. A The head covering of claim 2 wherein the pouch portion further comprises a receiving edge wherein said receiving edge includes means to secure the pouch to the wearer's hair.

4. The head covering of claim 1 wherein the head covering is made from a single piece of material and wherein said tie members are made from cut outs of said single piece of material.

5. The head covering of claim 1 wherein the cap portion comprises fabric with two generally identical and opposed arcuate edges wherein the two arcuate edges are connected to form a central longitudinal seam such that the cap portion generally covers and is contoured to a head of the wearer.

6. The head covering of claim 1 wherein the first edges and second edges of the front and back walls are sewn together and the bottom edges are integrally woven from a continuous fabric.

7. The head covering of claim 1 wherein the pouch is rectangular and lays against the back side of the torso of the wearer.

8. A head covering comprising:

a cap portion comprising fabric with two generally identical and opposed arcuate edges wherein the two arcuate edges are connected to form a central longitudinal seam such that the cap portion is generally contoured to the top of a head of a wearer, said cap portion further comprising a front end and a back end;

a pouch portion permitting hair of the wearer to be enclosed by the pouch portion, the pouch portion extending from a point above a nape of a neck of a wearer to a point below the nape of the neck and down at least a portion of a back side of a torso of the wearer, the pouch portion including:

a back wall extending below the nape of the neck, a front wall extending below the nape of the neck and resting against the neck and back side of the torso of the wearer, wherein the front wall and back wall each have a first edge, a second edge, and a bottom edge such that the edges are respectively secured, wherein the back wall is integral with the back end of the cap portion wherein said pouch portion hangs loosely beneath said cap portion, and a receiving edge along a top edge of the front including elastic encased therein for securing the pouch portion around hair of the wearer encased therein; and tie members connected to the front end of the cap portion.

9. A method of constructing a head covering for receiving hair of a wear in a pouch, the steps including:

providing a sheet of fabric;

forming a head covering blank from the fabric including the steps of:

forming a generally rectangular portion in the fabric with opposed first and second ends, forming a pair of opposed and arcuate edges at the first end of the rectangular portion, and forming a pair of tie members lateral to and integral with the first end of the rectangular portion;

connecting the arcuate edges to each other to form a cap portion;

folding a portion of the rectangular Portion including the second end over itself;

mating lateral edges of the folded portion of the rectangular portion; and securing the lateral edges of the folded portion to each other to form a pouch portion.

10. The method of claim 9 wherein the step of providing a sheet of fabric includes securing together a plurality of pieces of fabric.

11. The method of claim 9 further comprising the step of providing an elastic at the second end.

* * * * *